US006766535B2

(12) United States Patent
Duhamell et al.

(10) Patent No.: US 6,766,535 B2
(45) Date of Patent: Jul. 27, 2004

(54) INFLATABLE SAFETY VEST

(75) Inventors: John Duhamell, 1940 W. Park Ave., Redlands, CA (US) 92373; Robert J. Weygand, Costa Mesa, CA (US); George Alvarez, 28 Highpoint, Trabuco Canyon, CA (US) 92679; Douglas J. Anderson, Murrieta, CA (US)

(73) Assignees: John Duhamell, Redlands, CA (US); George Alvarez, Trabuco Canyon, CA (US)

( * ) Notice: Subject to any disclaimer, the term of this patent is extended or adjusted under 35 U.S.C. 154(b) by 0 days.

(21) Appl. No.: 10/405,722

(22) Filed: Apr. 2, 2003

(65) Prior Publication Data

US 2003/0188371 A1 Oct. 9, 2003

Related U.S. Application Data

(63) Continuation-in-part of application No. 10/043,917, filed on Jan. 11, 2002, now Pat. No. 6,546,561.
(60) Provisional application No. 60/261,480, filed on Jan. 12, 2001.

(51) Int. Cl.[7] ..... A41D 1/04
(52) U.S. Cl. ..... 2/102; 2/456
(58) Field of Search ..... 2/102, 455, 456, 2/463, 464, 465, 467, 411, 413, DIG. 3, 462, 94, 250, 247, 248, 249, 253, 51; 441/88, 90, 92, 93, 94, 96

(56) References Cited

U.S. PATENT DOCUMENTS

| | | | | |
|---|---|---|---|---|
| 1,704,197 A | * | 3/1929 | Journey | 441/92 |
| 3,930,667 A | | 1/1976 | Osuchowski et al. | |
| 4,059,852 A | | 11/1977 | Crane | |
| 4,089,065 A | * | 5/1978 | McGee | 2/456 |
| 4,637,074 A | | 1/1987 | Taheri | |
| 4,685,151 A | | 8/1987 | Kincheloe | |
| 4,825,469 A | | 5/1989 | Kincheloe | |
| 5,746,442 A | | 5/1998 | Hoyaukin | |
| 5,759,076 A | * | 6/1998 | Bateman et al. | 441/115 |
| 5,781,936 A | | 7/1998 | Alaloof | |
| 5,867,842 A | | 2/1999 | Pinsley et al. | |
| 6,076,715 A | * | 6/2000 | Easter | 224/149 |
| 6,125,478 A | | 10/2000 | Alaloof | |
| 6,230,333 B1 | | 5/2001 | Umeda | |
| 6,350,168 B1 | | 2/2002 | Kroll et al. | |

FOREIGN PATENT DOCUMENTS

DE 197 50 898 A1 4/1999

* cited by examiner

*Primary Examiner*—Gary L. Welch
(74) *Attorney, Agent, or Firm*—Klein, O'Neill & Singh, LLP; Howard J. Klein

(57) ABSTRACT

A body protection device in the form of an inflatable vest includes an inflation mechanism that is actuated upon separation or removal of the wearer from a vehicle. A compressed gas cartridge is held in an interior pocket of the vest and attached to an inflatable bladder. The compressed gas cartridge communicates with the interior of the bladder through a cartridge actuation mechanism and an inflation tube. The cartridge actuation mechanism includes a triggering device that operates an actuation lever to open the cartridge. The actuation lever is actuated in response to a pulling force of predetermined magnitude that detaches the triggering mechanism from the actuation mechanism. The actuation lever is connected to the vehicle by a lanyard, which lanyard, when a wearer of the vest is forcibly separated from the vehicle, actuates the triggering device before detaching from the actuation mechanism, thereby opening the cartridge to inflate the vest.

12 Claims, 9 Drawing Sheets

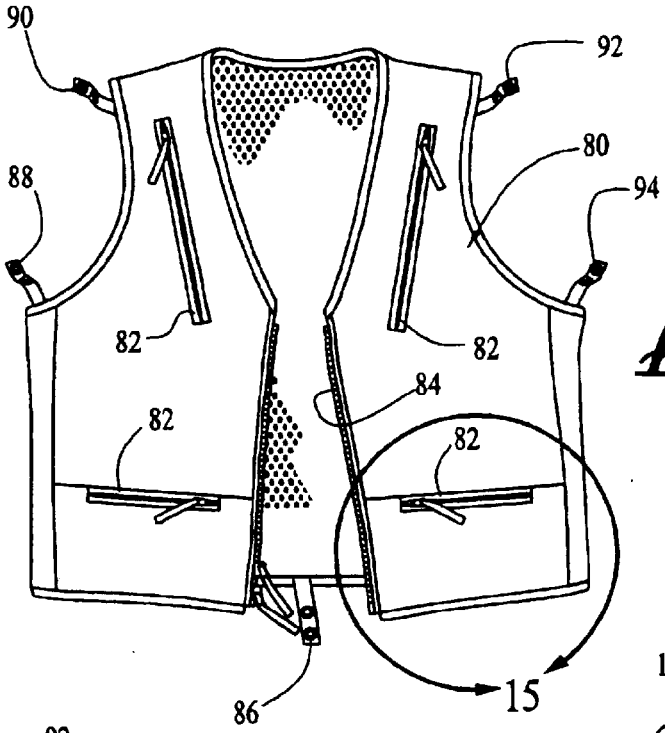
FIG. 14
FIG. 15
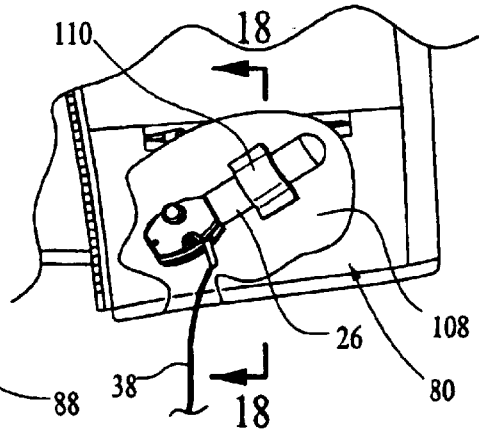
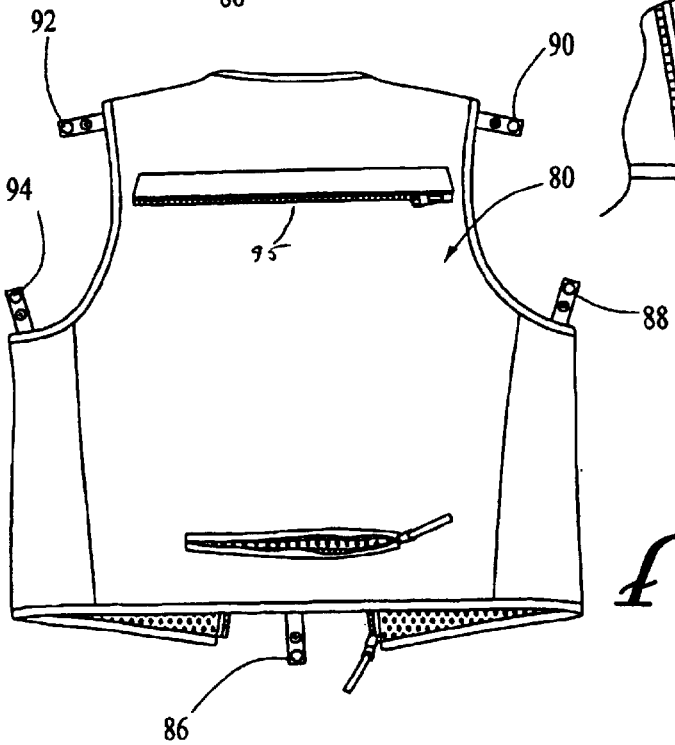
FIG. 16

INFLATABLE SAFETY VEST

CROSS-REFERENCE TO RELATED APPLICATION

This application is a Continuation-in-Part of application Ser. No. 10/043,917; filed Jan. 11, 2002, now U.S. Pat. No. 6,546,561. The prior application claims the benefit, under 35 U.S.C. Section 119(e), of Provisional Application No. 60/261,480; filed Jan. 12, 2001.

FEDERALLY-FUNDED RESEARCH OR DEVELOPMENT

Not Applicable

BACKGROUND OF THE INVENTION

The present invention relates to the field of body protection devices, and more particularly to items of apparel that are inflatable so as to offer protection to a part of the wearer's body.

Inflatable items for the protection of a part of the human body are well known. For example, items such as protective pads and helmets have been made with inflatable bladders to offer protection to a body part from blows, falls, and other sources of trauma. Also known are inflatable vests used as life preservers, i.e., to provide added buoyancy to keep the human body afloat in water.

Inflatable life vests of conventional design typically include a unitary internal bladder that is connected to a source of pressurized gas, typically a $CO_2$ cartridge. The cartridge must be actuated manually, by pulling an actuation cord connected to a valve-actuation pin that opens a valve connecting the cartridge to a gas inlet tube communicating with the bladder.

In certain situations, it may be desirable to protect a person from a sudden trauma that may occur while the person is engaging in a hazardous or semi-hazardous activity. There may not be sufficient time or an appropriate opportunity to manually actuate the inflation mechanism of an inflatable protective garment (such as a vest) before the blow or fall is suffered. An example of such an activity is riding a mountain bike, motorcycle, ATV, personal water craft or other vehicle. While in some cases (particularly in riding a personal water craft), it may be acceptable or even desirable to wear a pre-inflated vest, in the case of motorcycle riding, it is not practical to do so. Consequently, motorcycle riders typically wear bulky jackets made of leather or other heavy material to offer protection in a fall. These bulky garments, however, are often uncomfortable, particularly in hot weather.

There has accordingly been a long-felt need for an inflatable protective garment that can be worn comfortably in a deflated condition, either alone or with a further jacket, and yet that can be automatically and nearly instantaneously inflated upon the onset of a potentially trauma-inducing incident. There further exists a long felt need for such an inflatable protective device that is aesthetically pleasing and does not resemble a protective garment.

SUMMARY OF THE INVENTION

Broadly, the present invention is a body protection device in the form of an inflatable garment having an inflation mechanism that is actuated in response to the separation or removal of the wearer from a motor vehicle, in particular, a motorcycle, ATV, snowmobile or personal water craft. In a specific preferred embodiment, the invention is embodied as an inflatable vest, comprising an inflatable bladder configured as a vest, a compressed gas cartridge communicating with the interior of the bladder through an inflation tube, and a cartridge actuation mechanism comprising a triggering device that can be actuated to open the cartridge. The triggering device includes an actuation lever that actuates the triggering device, and in doing so detaches from the actuation mechanism, upon being pulled with a force of predetermined magnitude. The invention further comprises a lanyard having a first end connected to the actuation lever and a second end that is attachable to the vehicle. When the wearer is thrown or forcibly separated from the vehicle, the lanyard exerts an actuation force on the actuation lever, which actuates the triggering device before detaching from the actuation mechanism, thereby opening the cartridge and allowing the gas from the cartridge to inflate the bladder.

In a further embodiment, the inflatable vest comprises an inflatable bladder configured as a vest that may be worn alone or under a jacket to which it may be removably held. The further embodiment is designed so as to resemble an article of clothing, and includes a compressed gas cartridge communicating with the interior of the bladder through an inflation tube that is held within an interior pocket formed in the vest, and which is hidden from view in the vest. A cartridge actuation mechanism comprising a triggering device that can be actuated to open the cartridge is also held in the interior pocket. The second embodiment of the invention also comprises a lanyard having a first end connected to one or more actuation levers in one or more interior pockets of the vest and a second end that is attachable to the vehicle. When the wearer is thrown or forcibly separated from the vehicle, the lanyard exerts an actuation force on the actuation lever(s), which actuates the triggering device(s) before detaching from the actuation mechanism, thereby opening the cartridge(s) and allowing the gas from the cartridge(s) to inflate the bladder.

BRIEF DESCRIPTION OF THE DRAWINGS

FIG. 14 is a front elevational view of a third preferred embodiment of the present invention in an open position and including jacket securing elements on the vest;

FIG. 15 is a partial cut-away view taken along line 15 of FIG. 14 showing details of at least one compressed gas cartridge and actuation mechanism held at an angle in an interior pocket formed in the vest;

FIG. 16 is a rear elevational view of the vest of FIG. 14;

DETAILED DESCRIPTION OF THE PREFERRED EMBODIMENT

Figure 1:
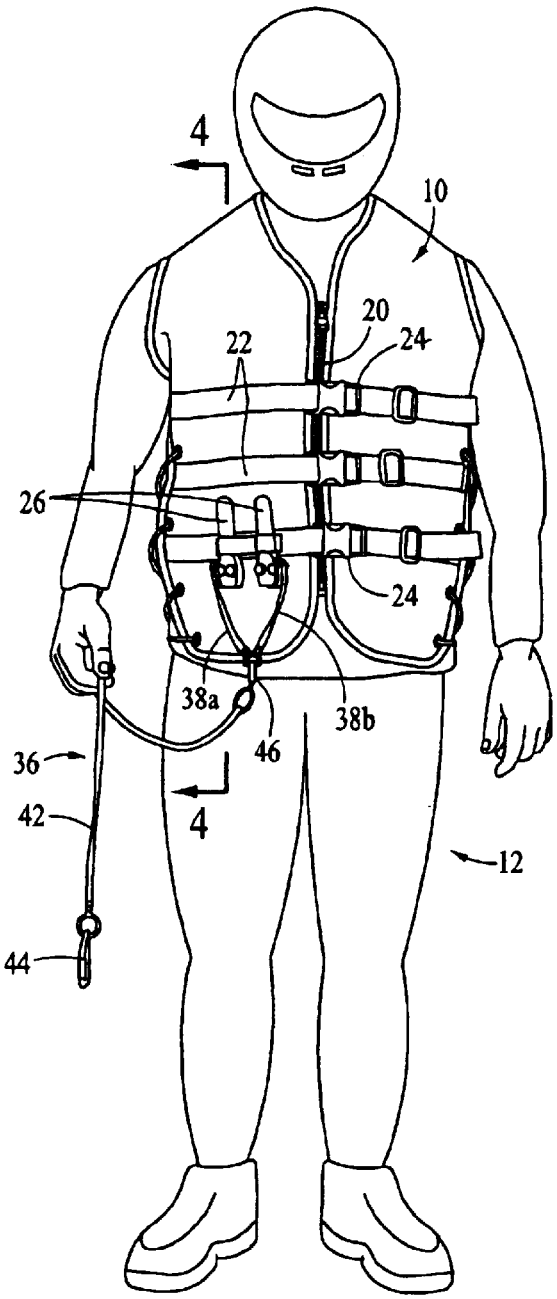
FIG. 1 is a front elevational view of a person wearing an inflatable safety vest in accordance with a first preferred embodiment of the present invention, the vest being in its deflated state.
Figure 2:
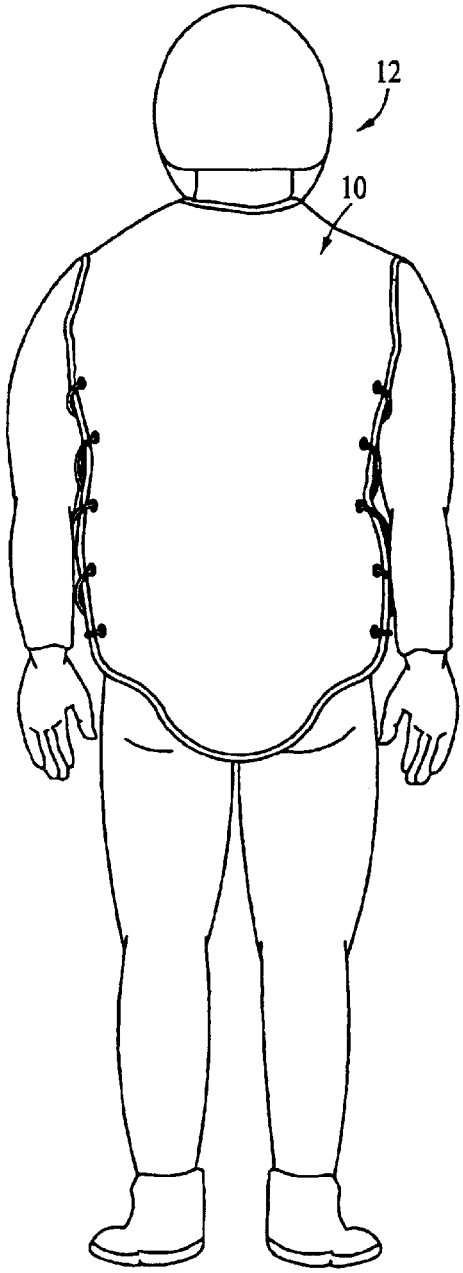
FIG. 2 is a rear elevational view of the person and vest of FIG. 1.
Figure 3:
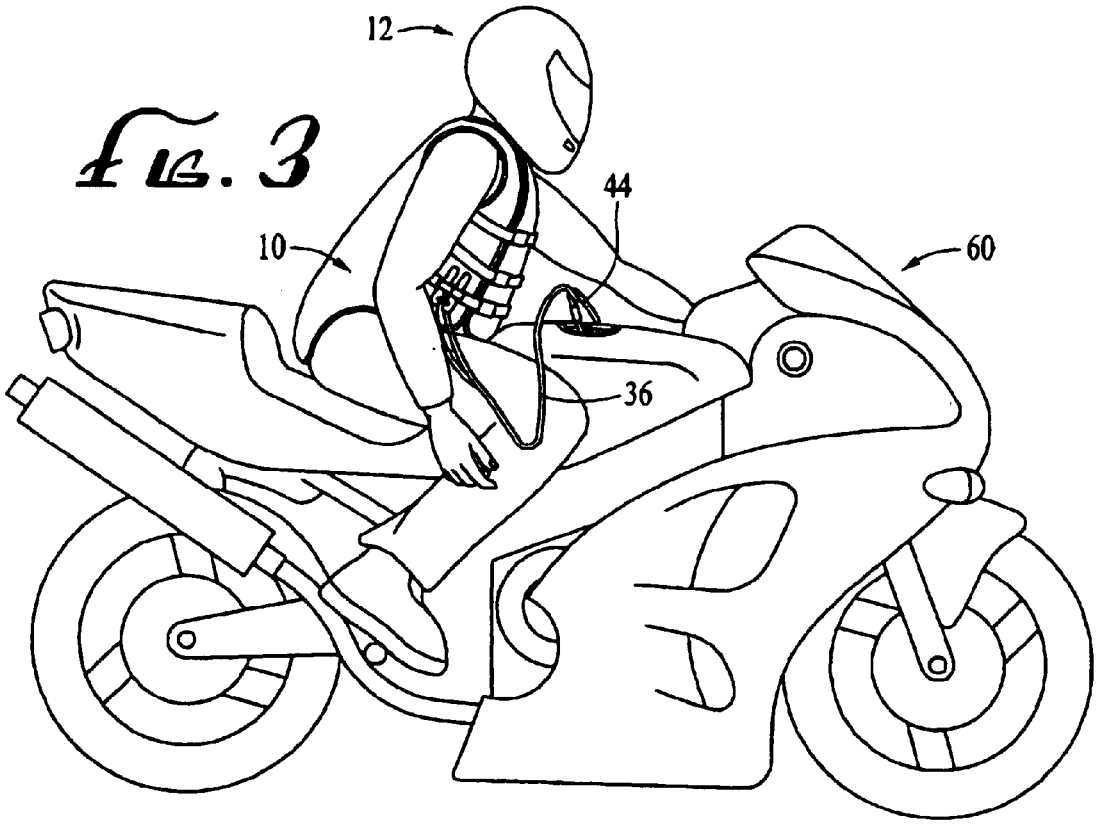
FIG. 3 is a side elevational view of a person wearing the vest of FIG. 1 while 2 riding a motorcycle, the vest being in its deflated state.
Figure 4:
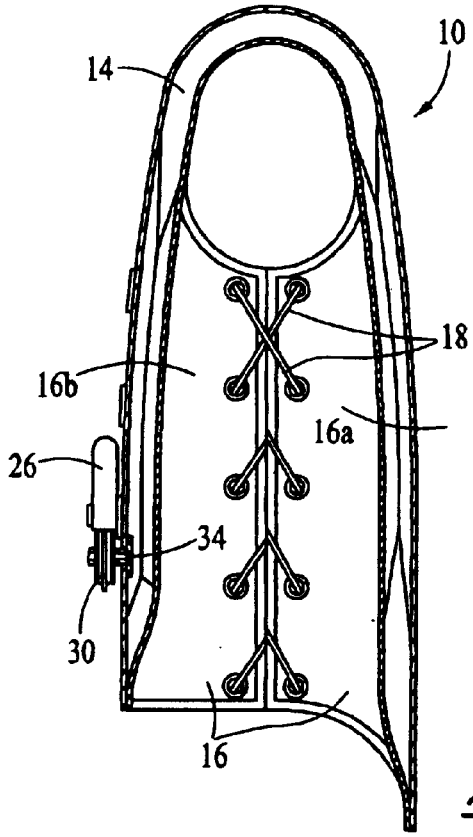
FIG. 4 is a cross-sectional view of the vest of FIG. 1, taken along line 4—4 of FIG. 1, but omitting the person wearing the vest.

FIGS. 1, 2, and 3 show an inflatable safety vest 10, in accordance with a preferred embodiment of the present invention, being worn by a person 12 wearing the other apparel typically worn by a motorcycle rider. In these Figures, the vest 10 is shown in its deflated state. The vest 10, as best shown in FIG. 4, comprises an inflatable, gas-tight bladder 14 configured to form a unitary back portion, left and right shoulder portions, and left and right chest portions of the vest. The vest 10 also includes side panels 16 connecting the chest and back portions. The side panels 16 may be unitary, or, as shown in FIG. 4, they may each be divided into front and rear portions 16*a*, 16*b*, respectively, connected to each other by means such as laces 18. The left and right chest portions of the vest 10 are attachable to each other by fastening means such as a zipper 20, although other means, such as snaps, buttons, hook-and-loop fasteners, and buckles may also be used. Size adjustment means may be provided to assure a snug and secure fit of the vest 10 on persons of different sizes. For example, one or more cross-straps 22, which are length-adjustable by means of buckles 24, may be attached to the outside of the vest 10.

As shown in FIGS. 1, 4, 6, and 7, the vest 10 is provided with a source of compressed gas for inflating the vest. In the preferred embodiment, the compressed gas source is at least one compressed $CO_2$ gas cartridge 26, and preferably two such cartridges 26, as shown. Each cartridge 26 is removably secured within a fabric loop 28 fastened to one of the straps 22. The gas cartridges 26 are of conventional design, and are commercially available from a number of sources. While such cartridges come in a variety of sizes, two cartridges, each of the 16 gram net contents weight size, provide good results.

Figure 7:
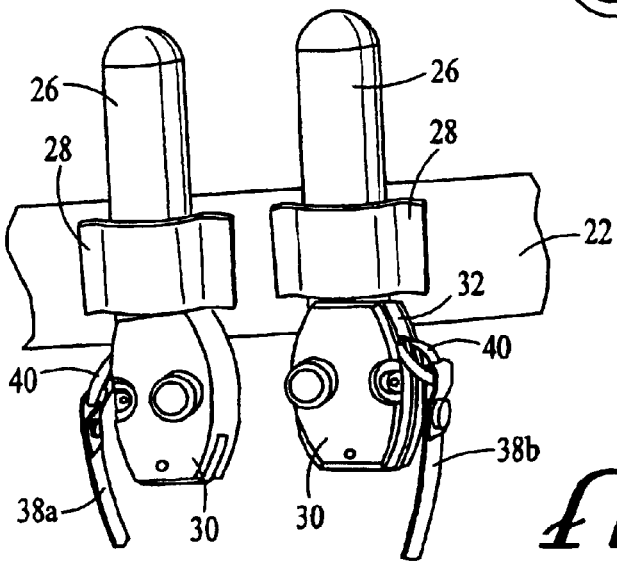
FIG. 7 is a detailed view of the compressed gas cartridges and the actuation mechanism used in the present invention.

As shown in FIG. 7, each cartridge 26 is removably coupled (as by a threaded fitting, not shown) to a cartridge actuation mechanism 30. The actuation mechanism 30 is of conventional design, and is commercially available from a number of sources. For example, if 16 gram cartridges are used, the actuation mechanism 30 may be the Model 840AM, manufactured by Halkey-Roberts, of St. Petersburg, Fla., or the equivalent. The actuation mechanism 30 includes a triggering device that comprises an actuation lever 32 that is detachably connected to a spring-loaded pin or rod (not shown), installed in the actuation mechanism 30 so as to rupture the neck of the cartridge 26 when the lever is pulled with a force of predetermined magnitude, thereby opening or "firing" the cartridge 26.

The vest is provided with a pair of inflation tubes 34 (only one of which is shown in FIG. 4). Each inflation tube 34 has a first end on the exterior of the vest that is connected to one of the cartridges 26 through its associated actuation mechanism 30, and a second end opening into the interior of the bladder 14. When a cartridge 26 is opened, as described above, gas from the open cartridge 26 passes through its associated inflation tube 34 into the interior of the bladder 14 to inflate the vest. When the lever 32 is pulled with a force sufficient to actuate the actuation mechanism 30, the lever 32 detaches from the mechanism 30.

The invention further comprises a lanyard 36 having a Y-shaped or bifurcated proximal portion comprising two branches 38*a*, 38*b*, each of which is secured to one of the actuation levers 32 by an attachment ring 40. If only one cartridge 26 is used, the proximal portion of the lanyard 36 will be unitary, rather than bifurcated. The lanyard 36 has a main portion 42 with a distal end that is terminated by a clip 44. The main portion 42 is advantageously connected to the proximal portion by a snap fitting 46 that permits the main portion 42 to be detached from the proximal portion.

Figure 5:
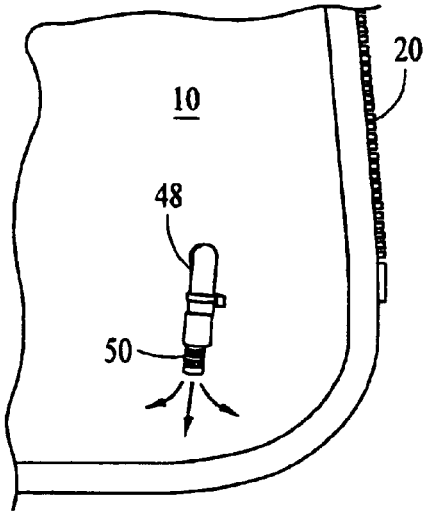
FIG. 5 is a detailed view of a portion of the inwardly-facing surface of the vest, showing a deflation tube that is advantageously included with the vest.

FIG. 5 shows a bladder deflation tube 48 that is advantageously provided on the inner surface of the vest, preferably on the lower part of one of the chest portions. The deflation tube 48 communicates between the interior of the bladder 14 and the ambient atmosphere through a deflation valve 50, of conventional design, that can be manually opened to deflate the vest 10 after it has been inflated. The valve 50 may, for example, be of the well-known type that is rotated in opposite directions to move it respectively toward and away from a valve seat to close and open the valve, respectively.

Figure 6:
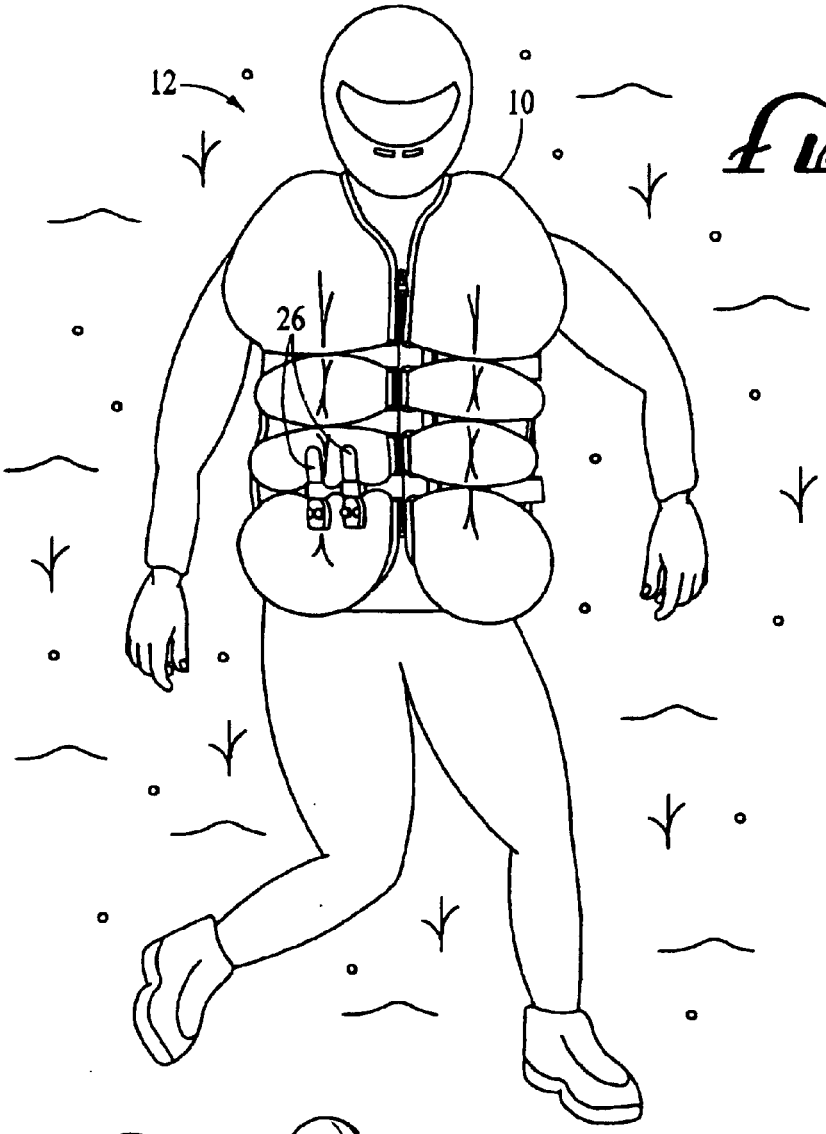
FIG. 6 is a front elevational view of the person lying on the ground with the vest in its inflated state.

In operation, as shown in FIG. 3, a person 12 wears the vest 10 while riding on a vehicle, such as a motorcycle 60. The vest 10 is normally in its deflated state. The proximal lanyard branches 38*a*, 38*b* are respectively secured to the levers 32 of the triggering devices in the two actuation mechanisms 30. The levers 32, in turn, are attached to their respective actuation mechanisms 30. The distal end clip 44 of the lanyard 36 is clipped to a convenient portion or component of the vehicle 60. Should the person 12 be thrown from or fall off of the vehicle 60, the resulting force applied to the lanyard 36 is transmitted to the actuation levers 32, resulting in the actuation of the triggering devices in the actuation mechanisms 30, thereby firing the cartridges 26 to inflate the bladder 14 through the inflation tubes 34. At the same time, the actuation force applied to the lanyard 36 is sufficient to separate the actuation levers 32 from the actuation mechanisms 30. Consequently, as shown in FIG. 6, the vest 10 is inflated before the person 12 hits the ground, while the vest itself is separated from the lanyard 36. The impact of the fall is softened by the inflated vest 10, thereby reducing the likelihood of severe injuries. After impact, the vest 10 can be deflated for reuse by opening the deflation valve 50.

Turning now to FIGS. 8–12 and 13–18, there shown are second and third preferred embodiments of an inflatable safety vest 70, 80, in accordance with the present invention.

Figure 8:
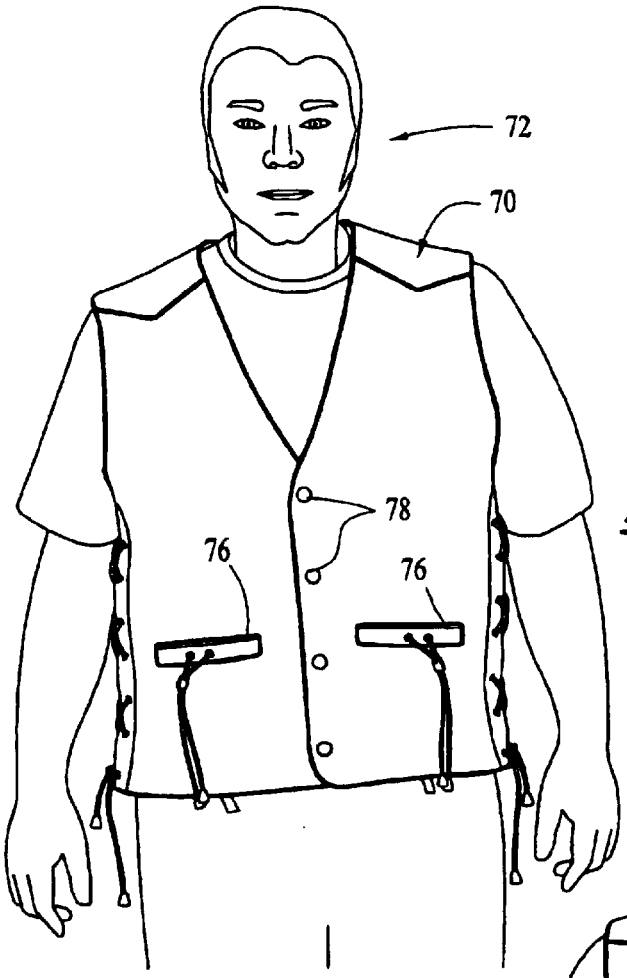
FIG. 8 is a front elevational view of a person wearing an inflatable safety vest in accordance with a second preferred embodiment of the present invention, the vest being in its deflated state.
Figure 9:
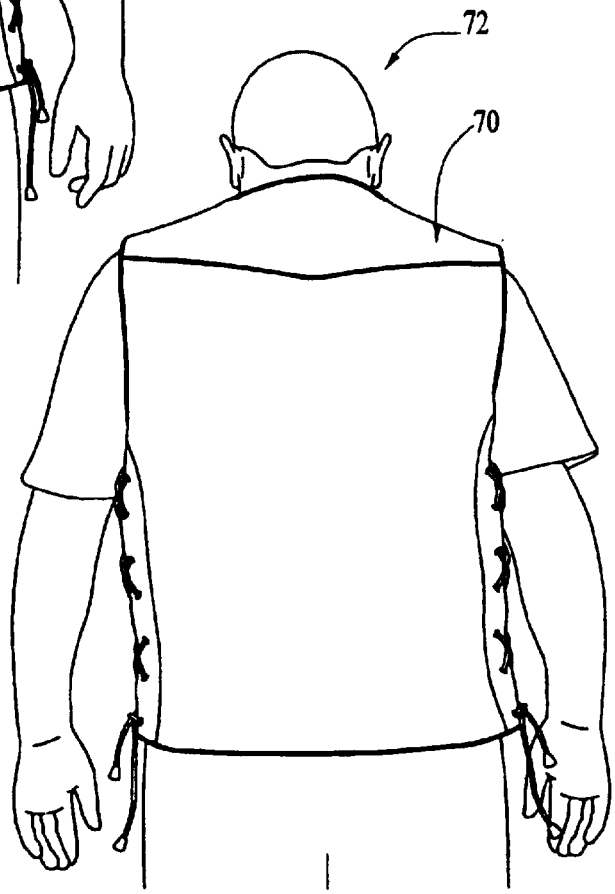
FIG. 9 is a rear elevational view of the person and vest of FIG. 8.
Figure 10:
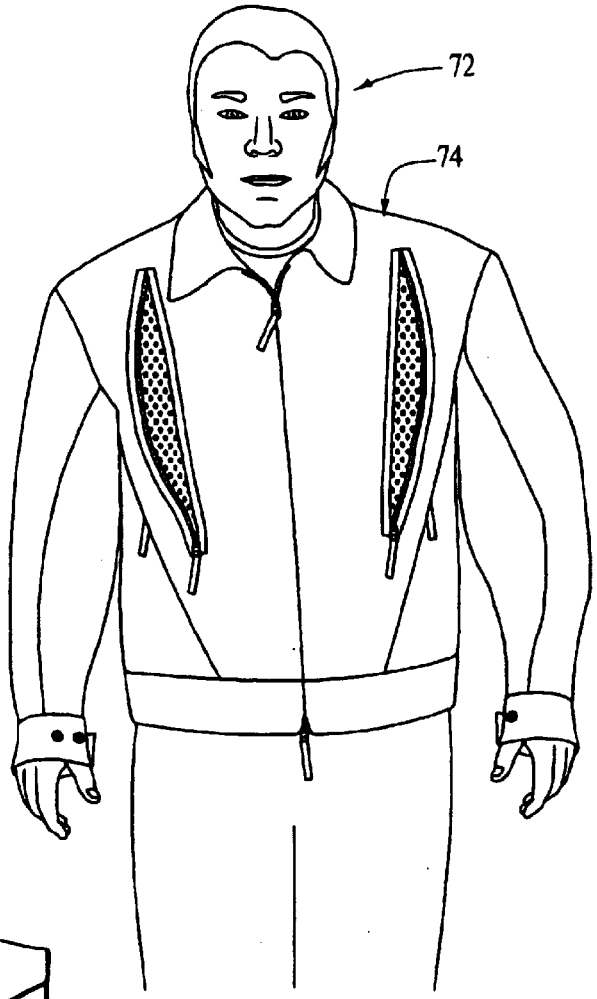
FIG. 10 is a front elevational view of a person wearing a jacket over the vest of FIG. 8, showing the jacket fitting over and concealing the vest.
Figure 11:
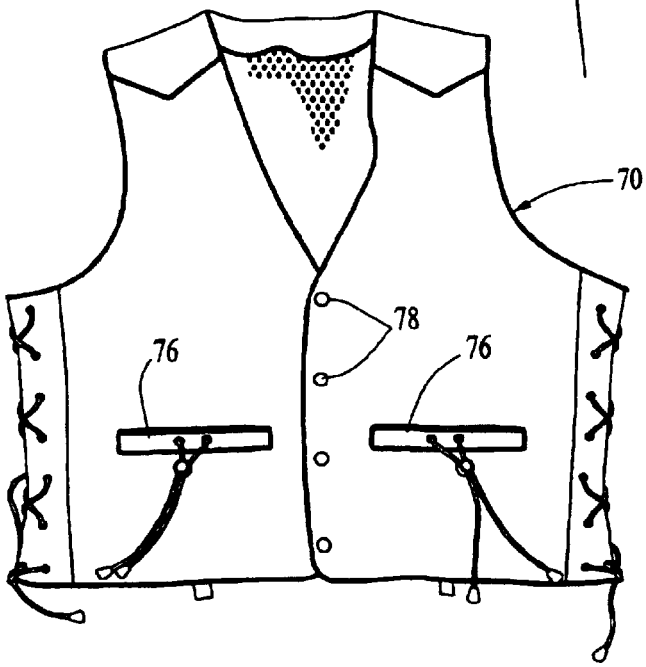
FIG. 11 is a front elevational view of the vest of FIG. 8.
Figure 12:
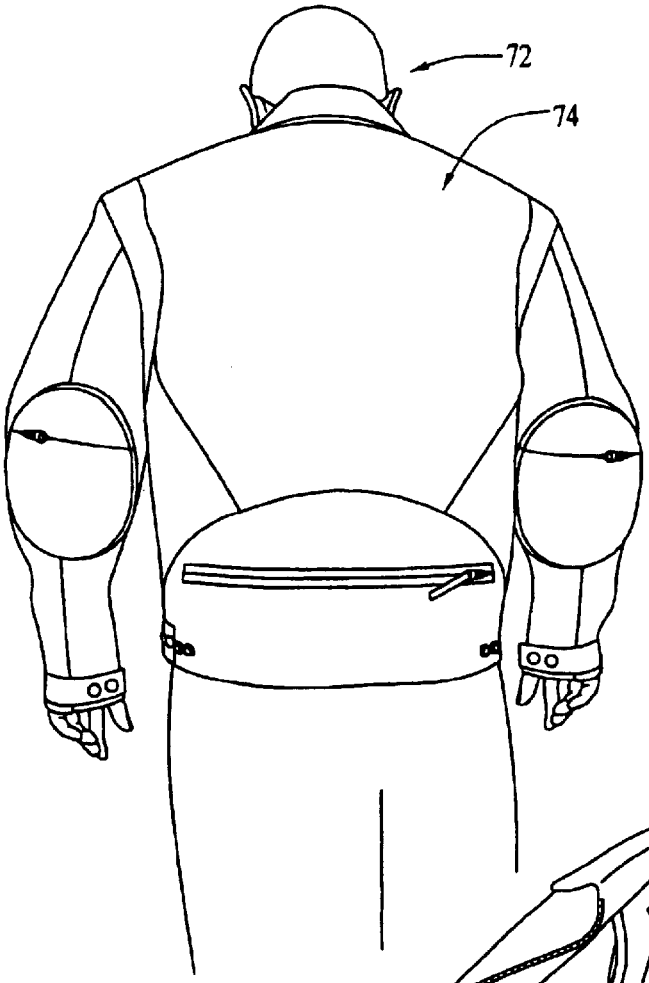
FIG. 12 is a rear elevational view of the person and jacket of FIG. 10.
Figure 13:
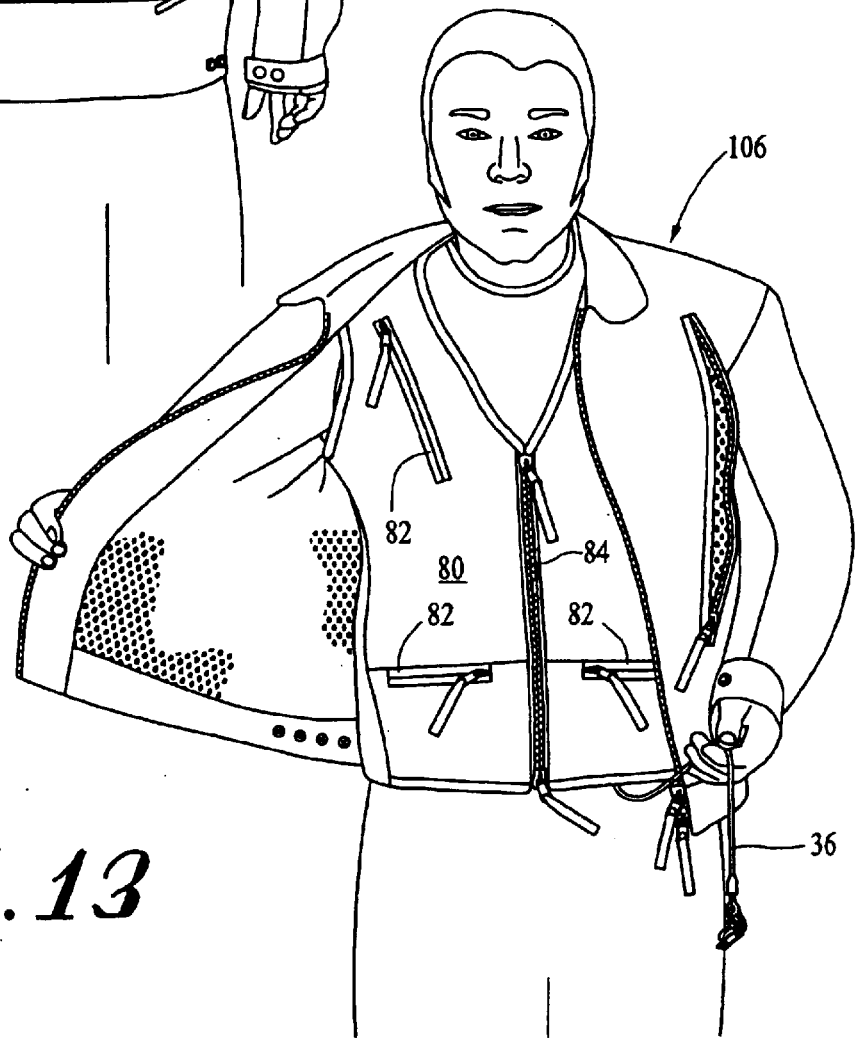
FIG. 13 is a front elevational view of a person wearing a jacket over a third preferred embodiment of a vest, as best shown in FIG. 14, with the jacket in an open position and partially raised so as to show a portion of the vest.
Figure 17:
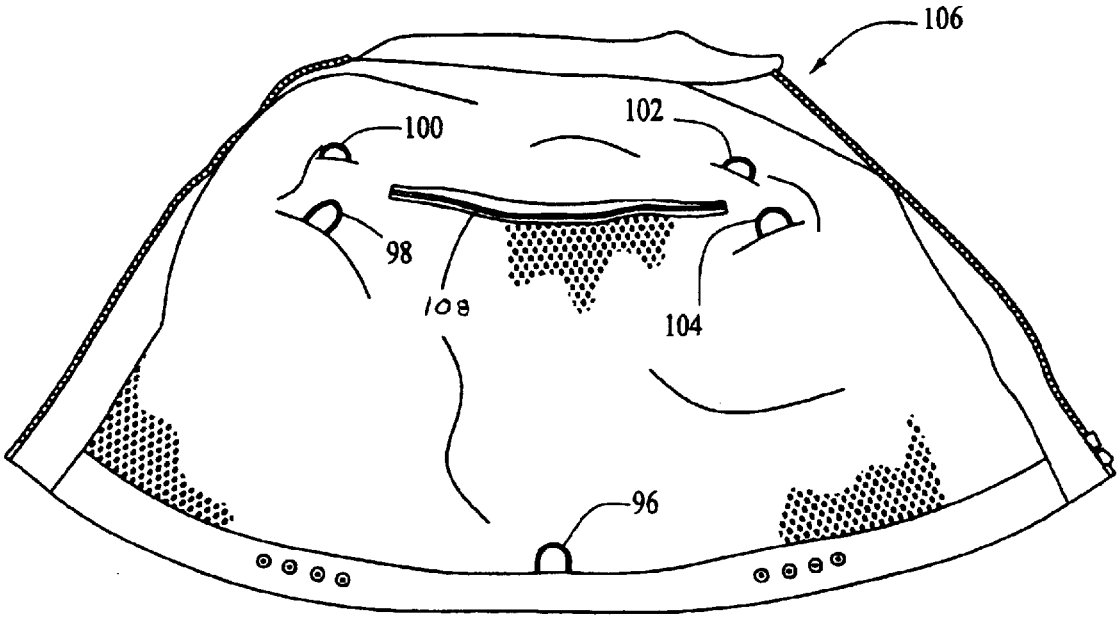
FIG. 17 is a front elevational view of a further embodiment of an open jacket showing securing portions therein for insertion and holding of the jacket securing elements of the vest of FIG. 14.

The vests 70, 80 may be made form any desired material to emulate a decorative article of clothing and may include any desired decorations or embellishment so as to enhance its looks when worn alone by a user, on or off a vehicle. For example, the vests may include one or more air vents, controlled by fastener means, such as zippers or the like. FIGS. 8 and 9 show the vest 70 being worn by a person 72, while FIGS. 10 and 12 show the person wearing a jacket 74 over the vest, while off of a vehicle, such as a motorcycle.

The vest 70 includes one or more pockets 76 having closure means, such as zippers, and front fastening means such as snaps 78, although other fastening means, such as buttons, hook-and-loop fasteners, buckles, a zipper, or the like, may also be used. Although not shown in FIGS. 8–12, the vest 70 includes at least one interior pocket for holding one or more $CO_2$ gas cartridges 26, such as described below in connection with vest 80. As shown in FIGS. 10 and 12, the vest 70 is sized and shaped so that it may be worn under or covered by the jacket 74.

As best shown in FIGS. 13–16 and 18, the vest 80 is substantially similar to the vest 70, and includes a plurality of air vents and exterior pockets 82, with closure means, such as zippers, and a front fastening means 84. Additionally, the vest 80 may be secured within another garment, such as a jacket, be a plurality of jacket securing elements 86, 88, 90, 92, 94, such as the tabs and snaps means shown attached at open arm portions and a bottom portion of the vest. Additionally, the vest may be provided with further jacket securing elements or means, such as an outside or partial zipper 95. The jacket securing elements 86, 88, 90, 92, 94 may be inserted into corresponding holding elements 96, 98, 100, 102, 104, such as loops, formed in any desired configuration and attached to the inside lining or surface of a jacket 106. The vest 80 may be inserted and held in the jacket 106 by having the securing elements 86, 88, 90, 92, 94 inserted into and fastened together around or on the holding elements 96, 98, 100, 102, 104, to thereby hold the vest and the jacket together. Furthermore, the zipper 95 may be inserted and held in a further zipper closure 108 held on the interior of the jacket 106. The tab and looped securing elements and/or holding elements may be flexible or resilient for ease in insertion and fastening together.

Figure 18:
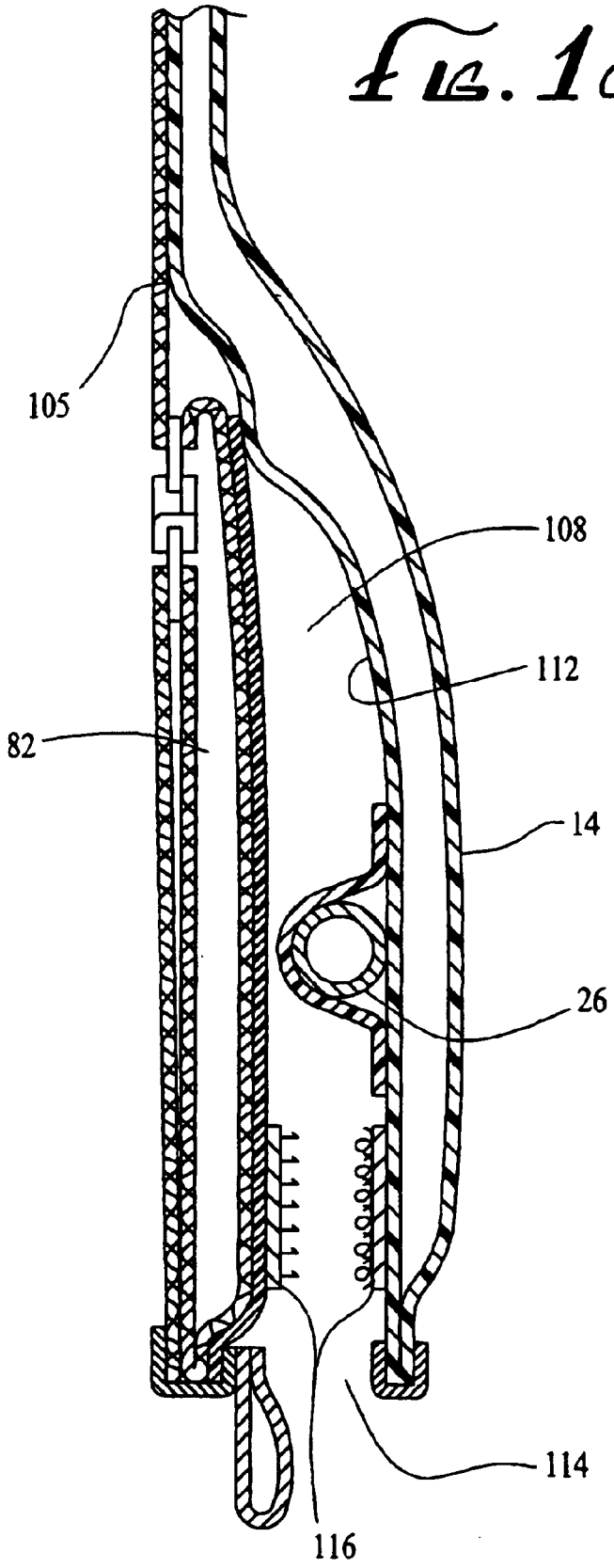
FIG. 18 is a partial cross-sectional, taken along line 18—18 of FIG. 15 showing details of the interior pocket and the compressed gas cartridge and actuation mechanism held therein.

Each of the vests 70, 80 comprises an inflatable, gas-tight bladder such as 14 in vest 10, having an exterior surface 105 formed thereon or secured thereto. The bladder 14 and exterior surface 105 are configured to form a unitary back portion, left and right shoulder portions, and left and right chest portions. The vests 70, 80 are provided with a source of compressed gas for inflating the vests. Each of the vests 70, 80 includes a compressed gas source comprising at least one compressed $CO_2$ gas cartridge 26, which are held in one or more interior pockets 108, as best shown in connection with vest 80 in FIGS. 15 and 18. Each cartridge 26 is removably secured within a loop 110, made from a fabric or other material, fastened to an inner surface or wall 112 of the bladder 14, so as to hold the cartridge against or secured to the inner surface. The one or more interior pockets 108 may be placed in any desired location behind the exterior surface 105, but are preferably formed between one or more of the exterior pockets 82 and the bladder 14, as shown in FIG. 18. Inflation tubes (not shown), such as inflation tubes 34, are connected between the one or more cartridges 26 and an opening in the inner surface 112 of the bladder 14, in the interior pocket 108. When a cartridge 26 is opened, as described above, gas from the open cartridge 26 passes through its associated inflation tube 34 into the interior of the bladder 14 to inflate the vest.

Each of the vests 70, 80 may also include bladder deflation tubes, such as 48, that communicate between the interior of the bladder 14 and the ambient atmosphere through a deflation valve, such as 50, of conventional design, that can be manually opened to deflate the vests 70, 80 after they have been inflated.

As best shown in FIG. 15, the one or more $CO_2$ gas cartridges 26 are preferably held at an angle in the interior pocket(s) 108. This angle may vary, but in one preferred embodiment for use on a motorcycle is approximately 30° to a bottom edge of the vests 70, 80.

Furthermore, as best shown in FIG. 18, the one or more interior pockets 108 may have lower or open ends 114 closed or secured together by a closure means 116, for example, by a hook and loop securing means, such as VELCRO®. When a user is off a vehicle such as a motorcycle, the lanyard 36 and its unitary 38 or bifurcated ends 38*a*, 38*b*, may be inserted in the interior pockets 108 and the closure means 116 closed to hold the same in the interior pocket. Thus, the vests 70, 80 provide aesthetically pleasing protective garment that simulate articles of clothing so that they may be easily worn off a vehicle. These vests do not resemble known protective garments and will appeal to those who do not wish to be seen wearing such protective garments.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A body protection device for a person riding a vehicle that resembles and may be warn as a garment, comprising:

an inflatable vest and having an exterior surface and an airtight interior bladder;

a first plurality of jacket securing elements attached to the inflatable vest;

at least one compressed gas cartridge held in at least one interior pocket formed in the inflatable vest between the exterior surface and the airtight interior bladder;

a cartridge actuation mechanism operably connected to the at least one compressed gas cartridge and comprising:

a triggering device that is operable to open the at least one compressed gas cartridge; and an actuation lever operatively connected to the triggering device so as to actuate the triggering device in response to a pulling force of a predetermined magnitude, wherein the actuation lever is detachable from the actuation mechanism in response to the pulling force of predetermined magnitude;

at least one inflation tube having a first end connected to the at least one gas cartridge through the actuation mechanism and a second end opening into the interior of the vest, whereby gas can flow from the at least one gas cartridge into the interior of the vest through the at least one inflation tube when the at least one gas cartridge is opened by the triggering device; and a lanyard having a first end connected to the actuation lever and a second end that is attachable to a vehicle, whereby the application of the pulling force of predetermined magnitude to the lanyard actuates the triggering device and separates the actuation lever from the actuation mechanism.

2. The body protection device of claim 1 wherein the at least one compressed gas cartridge is attached to a holding strap secured to a wall in the interior pocket.

3. The body protection device of claim 2 wherein the at least one interior pocket has an open portion having a securing means therein and the first end of the lanyard extends through the open portion.

4. The body protection device of claim 3 wherein the at least one compressed gas cartridge is attached at an angle to a bottom edge of the inflatable vest in the interior pocket.

5. The body protection device of claim 1, further including a jacket having a second plurality of securing elements attached thereto.

6. The body protection device of claim 5 wherein each of the first plurality of jacket securing elements is attachable to one of the second plurality of securing elements so as to secure the inflatable vest and jacket together.

7. The body protection device of claim 1, further comprising a deflation valve; and a deflation tube communicating between the interior of the vest and the ambient atmosphere through the deflation valve.

8. A body protection device in the form of an article of clothing for a person riding a vehicle, comprising:

an inflatable vest having an exterior surface and an airtight interior bladder, an inflation tube having a first end on an interior wall of the vest and a second end in the interior of the vest;

a first plurality of securing elements attached to the inflatable vest;

a jacket having a second plurality of securing elements attached thereto;

at least one compressed gas cartridge attached to a holding strap secured at an angle to a wall in an interior pocket formed in the vest behind the exterior surface and the airtight interior bladder and connected to the first end of the inflation tube;

a cartridge actuation mechanism operably connected to the at least one compressed gas cartridge and comprising:

a triggering device that is operable to open the at least one compressed gas cartridge; and an actuation lever operatively connected to the triggering device so as to actuate the triggering device in response to a pulling force of a predetermined magnitude, wherein the actuation lever is detachable from the actuation mechanism in response to the pulling force of predetermined magnitude; and a lanyard having a first end passing through an open portion of the interior pocket and connected to the actuation lever and a second end that is attachable to the vehicle.

9. The body protection device of claim 8, further comprising a deflation valve; and a deflation tube communicating between the interior of the vest and the ambient atmosphere through the deflation valve.

10. The body protection device of claim 9 wherein the at least one compressed gas cartridge is attached in the holding strap at an angle to a bottom edge of the inflatable vest.

11. The body protection device of claim 8, wherein each of the first plurality of securing elements is attachable to one of the second plurality of securing elements so as to secure the inflatable vest and jacket together.

12. A body protection device in the form of a simulated article of clothing for a person riding a vehicle, comprising:

the simulated article of clothing being an inflatable vest having an exterior surface and an airtight interior bladder;

a first plurality of securing elements attached to the inflatable vest;

a jacket having a second plurality of securing elements attached thereto, wherein each at the first plurality of securing elements is attachable to one of the second plurality of securing elements so as to secure the inflatable vest and jacket together;

at least one compressed gas cartridge attached to a wall of an inner pocket formed in the vest between the exterior surface and the airtight interior bladder;

a cartridge actuation mechanism held in the inner pocket and operably connected to the at least one compressed gas cartridge and comprising:

a triggering device that is operable to open the at least one compressed gas cartridge; and an actuation lever operatively connected to the triggering device so as to actuate the triggering device in response to a pulling force of a predetermined magnitude, wherein the actuation lever is detachable from the actuation mechanism in response to the pulling force of predetermined magnitude;

a lanyard having a first end connected to the actuation lever through a bottom opening in the interior pocket and a second end that is attachable to the vehicle;

a deflation tube communicating between the interior of the airtight interior bladder and the ambient atmosphere;

a deflation valve;

a deflation tube communicating between the interior of the vest and the ambient atmosphere through the deflation valve; and the at least one compressed gas cartridge being attached at an angle to the airtight interior bladder by a holding strap.

* * * * *